United States Patent [19]

Foltz

[11] 4,150,348

[45] Apr. 17, 1979

[54] MAGNETIC LATCHING COAXIAL SWITCH

[75] Inventor: Robert D. Foltz, Waterbury, Conn.

[73] Assignee: Bunker Ramo Corporation, Oak Brook, Ill.

[21] Appl. No.: 741,606

[22] Filed: Nov. 15, 1976

[51] Int. Cl.[2] ..... H01H 47/04

[52] U.S. Cl. ..... 335/4; 333/258; 335/170

[58] Field of Search ..... 335/4, 5, 170, 153; 333/97 S, 7 R

[56] References Cited

U.S. PATENT DOCUMENTS

| | | | |
|---|---|---|---|
| 2,584,901 | 2/1952 | Miller et al. | 335/5 |
| 2,911,498 | 11/1959 | Sausser | 335/5 |
| 3,194,921 | 7/1965 | Watts, Jr. | 335/4 |
| 3,394,324 | 7/1968 | McClaflin et al. | 335/4 |

*Primary Examiner*—Harold Broome

*Attorney, Agent, or Firm*—William Lohff; F. M. Arbuckle

[57] ABSTRACT

A switch for coaxial circuits is shown, including a moveable contact, a controller which controls the position of the moveable contact, and a latch to hold the moveable contact in the latest position determined by the controller. The moveable contact has an end which is permanently connected to a first terminal of a coaxial switch and a free end which may be connected to either of two other terminals of a coaxial switch as determined by signals to the controller. The controller includes a coil responsive to electrical current to magnetize an armature which is mechanically linked to the moveable contact. The latch includes a permanent magnet which reacts with a magnetized portion of the armature to force the armature and therefore the free end of the moveable contact into the latest position as determined by the polarity of the magnetic field of the coil.

19 Claims, 4 Drawing Figures

MAGNETIC LATCHING COAXIAL SWITCH

BACKGROUND OF THE INVENTION

FIELD OF THE INVENTION

The present invention relates to automatic switching systems which enable the switching, from a remote location, of high frequency electrical signals while maintaining isolation of switched signals. In particular it relates to a switching system which employs electromagnetic means to activate a mechanical linkage which controls a high frequency signal switch. It relates also to the provision of a permanent magnet to latch the mechanical linkage in a desired position. It relates further to a mechanical linkage for a remotely controlled switch in which flexible elements are provided to move easily and thus to enable the mechanical linkage and the signal switch to operate properly.

SUMMARY OF THE PRIOR ART

The CATV industry, or Cable Antenna Television Industry, has need for a switch which may be controlled from a distant location to connect and disconnect subscribers. The switch must be capable of latching in either of two positions so that power does not have to be applied to the switch except when a subscriber is being connected to or disconnected from the CATV service. Such a switch must be located on a service pole or the like so that it will not be subjected readily to abuse from vandals. The switch must be capable of operation by application of a DC voltage from some convenient location, such as system control center or a business office, to avoid the requirement that system employees physically travel around the CATV network to make connections and disconnections.

For CATV applications, the switch may be a single-pole double-throw switch capable of maintaining high values of isolation for RF signals. To this end it is necessary that the switch include provisions enabling large physical separation between output terminals. At the same time that isolation is maintained from a disconnected output terminal a good connection must be established and maintained between the input terminal and the connected output terminal.

Known prior art switches use with CATV systems include switches for coaxial circuits such as are shown in U.S. Pat. Nos. 3,689,854 and 2,584,901. The switches shown in these patents employ springs as biasing devices to urge their respective switches into a first closed position in the absence of an electrical signal. There is no showing in the switches shown in these patents of latching means to retain the switch in the second closed position in the absence of an energizing signal. Consequently, with the prior art, it is apparent that it will be necessary to supply energy on a continuous basis to maintain switches in the second closed position. This requirement for the continuous supply of electrical power to latch a switch is objectionable in many circumstances in which switches will be required to remain in either of two states for long periods. It is especially objectionable in the CATV industry where switches may stay in either state for months or years.

SUMMARY OF THE INVENTION

In view of the foregoing, a primary object of the present invention is to provide a remotely controlled electrical switch embodying latching means which maintain the switch in either of two alternative positions without the need for the continuous drain of electrical energy. It is a further object of the invention to provide an improved mechanical linkage between latching means and switching means in an electrical switch to optimize the transfer of motion from the latching means to the switching means.

To attain the foregoing objects and objects ancillary thereto, a switch is provided with a moveable switch arm adapted for switching RF signals between a single terminal and either of a pair of additional terminals. To this end a single terminal of the switch is provided in the form of an RF connector port and each of the additional terminals is provided as a separate RF connector port which is spaced far enough from each other additional terminal to ensure good RF isolation. The switch arm is cantalevered at the single terminal with the free end moveable between the additional terminals so that a connection is possible from the single terminal to either of the additional terminals.

The switch controller is equipped with a rocker arm which is pivoted at one end and is extended through a coil which can be energized to produce a magnetic field to deflect the free end of the rocker arm. The free end engages a mechanical element which, in turn, is coupled to the switch arm.

A permanent magnet serves as a latch which is positioned to engage the free end of the rocker arm and latch it in a position which keeps the switch arm in contact with either selected one of the separate RF connector ports. Motion from one latch position to another depends on the polarity of DC voltage supplied to the coil. A voltage of one polarity will cause the rocker arm to move to or adhere to the North pole of the magnet whereas a voltage of opposite polarity will cause the rocker arm to move to or adhere to the South pole of the magnet. In other words, the magnet is positioned in the direction that flex causes the free end of the rocker arm to move.

BRIEF DESCRIPTION OF THE DRAWINGS

The foregoing and other objects of the invention, together with various features of the invention, will become clear on examination of the description of a preferred embodiment and the claims in conjunction with the drawings, in which:

BRIEF DESCRIPTION OF A PREFERRED EMBODIMENT

Figure 1:
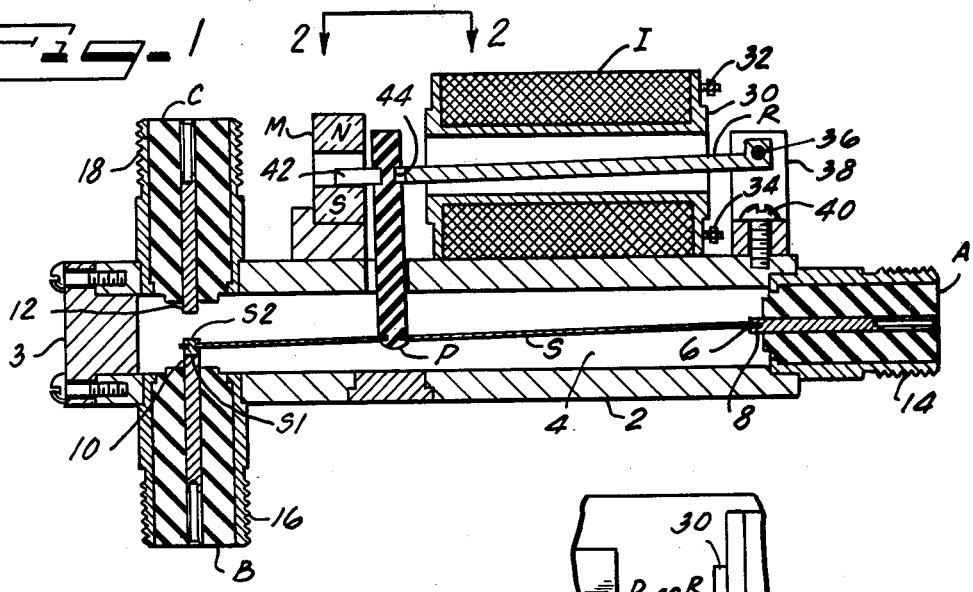
FIG. 1 is a sectional view of an embodiment of the invention with an electrical connection completed through a first and a second RF connector port.

Turning now to FIG. 1, a sectional view is shown of an embodiment of a coaxial switch in accordance with the invention. The switch includes electrical switch means to enable the completion of electrical circuits and electro-mechanical means to operate the switch means. The respective switch means and electro-mechanical means are electrically isolated from each other.

In this view, the electrical switch means incorporates a plurality of radio frequency, or RF connector ports A, B and C which are secured to a hollow body 2 which is closed at one end by a plug 3. Coupling between port A and port B is accomplished over a blade, or switch arm, S which extends through a cavity 4 in the body 2 from port A to port B. The switch arm S is formed of a thin blade of flexible metal which is connected mechanically and electrically, as by soldering or brazing, at 6 to the center contact 8 of the RF connector port A. The free end of the switch arm incorporates contact faces at s1 and s2 which are used to complete electrical connections between the center contact 8 of the RF connector A and the center contacts 10 and 12 of the RF connectors B and C, respectively.

In many RF switch applications, high values of isolation are necessary in single-pole double-throw switches. Considering FIG. 1, let port A be the input port and ports B and C be output ports, though it will be recognized that port A may be an output port and port B and C may function as input ports, if desired. Isolation, as it relates to the electrical connection shown in FIG. 1, may be expressed as the ratio of the RF power received at port C to the power received at port B. To achieve the isolation required, a physical separation of the contact at s2 on blade S and the center contact 12 of port C must be present. The higher the value of isolation required, the greater the physical separation required between the blade S and the center contact 12. As the requirements for separation are increased the need for special features of the present invention increases also.

Figure 3:
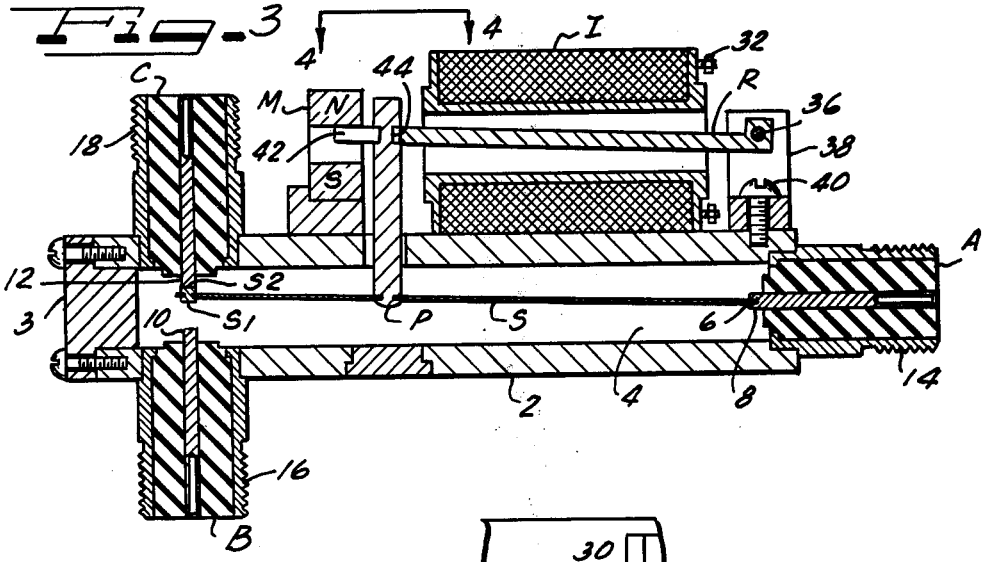
FIG. 3 is a sectional view of an embodiment of the invention showing a completed connection through different connector ports.

The RF connector ports A, B and C include threaded portions 14, 16 and 18, respectively, which may be coupled to coaxial cables or the like (not shown). When RF conductors are properly connected at 14 and 16, RF signals may be routed to and from the conductor via connector port A, contact s1 of the switch blade S and connector port B. If the switch blade is moved, as shown in FIG. 3, to place contact s2 in contact with the center contact 12 of port C, RF signals will be routed between a conductor coupled at 14 and one coupled at 18.

The position of the contact blade S relative to ports B and C is determined by a pin P. The position of the pin P, in turn, is governed by a controller assembly outside the hollow body 2 which includes a coil I, and a rocker arm R. A permanent magnet M may be characterized separately as a latch, but it also functions in cooperation with the controller as part of the controller magnetic circuit to determine the position of the rocker arm.

The coil I is wound on a form at 30 to function as an electromagnet responsive to DC electrical signals which may be supplied from a source, not illustrated, over terminals indicated at 32 and 34. The rocker arm R is pivoted at 36 on a rocker arm support 38 which, in turn, is secured to the body 2 by a screw at 40 or by other means, not shown.

The blade S is made of thin flexible material which can transmit RF signals. The pin P is made of dielectric material which may be peened over or otherwise fastened to secure the pin to the blade. This arrangement establishes the angle between the pin and the blade in the region where they are connected. If the part of the pin in contact with the rocker arm were not free to slide in the slot of the rocker arm, the movement of the end of the blade at s1 or s2 in contact with the center contact of port B or port C would be restricted because the pin would not be able to change its angle with respect to the vertical. As a result, the section of the blade between the pin P and the connector center contacts 10 and 12 of ports B and C would not be able to change its angle with respect to the vertical. Therefore, the movement of the contacts s1 and s2 at the end of the blade would be restricted in their contact with the connector center contacts 10 and 12 of ports B and C.

It is intended to compensate for the rigidity between the pin P and the blade S, which is described in the last paragraph, and to enable changes in the angle between the pin and the vertical as the blade S moves from contact with port B to contact with port C and vice versa. Compensation is achieved in a preferred embodiment by providing the free end of the rocker arm R with an elongated slot 42 which extends from the end of the arm R and which engages a cylindrical shaped slot 44 in the pin P. With the portion 44 of the pin in contact with the rocker arm and free to move in the slot 42 of the rocker arm, the pin is free to change its angle with respect to the vertical and thus the angle between the blade and the vertical can change. Maximum movement of the end of the blade at ports B and C is permitted in this way.

Figure 2:
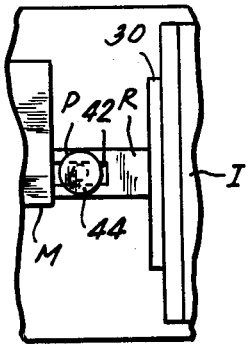
FIG. 2 is a view along 2—2 in FIG. 1 showing relationships between the rocker arm and the pin.
Figure 4:
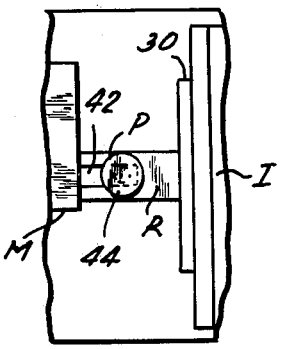
FIG. 4 is a view along 4—4 in FIG. 3 showing relationships between the rocker arm and the pin.

Attention is directed to the relationships of the slots 42 and 44 to each other and to the pin P and the rocker arm R in the figures for a clearer understanding of the way in which these relationships compensate for the lack of mobility between the blade S and pin P. In particular, it will be noted from FIGS. 1 and 2 that the pin P has moved in the slot 42 toward the end of the rocker arm R to enable a good connection to be established between s1 and 10. To enable a good connection between s2 and 12, as indicated in FIG. 3, the pin P is shown in FIGS. 3 and 4 to have moved in the slot 42 away from the end of the rocker arm R.

In operation, to switch from the condition of FIG. 1, where s1 is in contact with 10 in port B to the alternative condition shown in FIG. 3, where s2 is in contact with 12 in port C, the coil I is energized with a DC signal having a polarity that will cause the end of the rocker arm R, which is in contact with the South pole of the permanent magnet, to become a South pole. The rocker arm is constructed of a soft magnetic alloy of very low retentivity which may be magnetized very easily and which loses its magnetism very quickly when the magnetizing force is removed. This induced magnetic field creates a repelling force between the South pole of the rocker arm and the South pole of the permanent magnet. At the same time, an attracting force is induced between the North pole of the permanent magnet and the South pole of the rocker arm. The combination of the repelling and attracting forces causes the rocker arm to move toward the North pole of the permanent magnet. The rocker arm moves the blade from contact with port B to contact with port C by means of the pin P, which connects the blade and the rocker arm. When the rocker arm makes contact with the North pole of the permanent magnet, the current may be stopped in the coil and the rocker arm will be retained in contact with the North pole of the permanent magnet due to the magnetic attraction of the pole for the soft magnetic alloy in the rocker arm.

When the blade is in contact with the center contact of port C as shown in FIG. 3 it will remain in that position until DC voltage is supplied to the coil I in a direction that causes the coil to induce a North pole in the section of the rocker arm in contact with the North pole of the permanent magnet. When a North pole occurs in the end of the rocker arm, the rocker arm will be forced to move to contact the South pole of the permanent magnet in accordance with the analysis given above.

While the principles of the invention have been described above in connection with specific apparatus and applications, it is to be understood that this description is made only by way of example and not as a limitation on the scope of the invention.

I claim:

1. A remotely controlled latching switch comprising an input terminal, a plurality of output terminals, switching means for connecting the input terminals separately to each of said output terminals, controller means for establishing a connection via said switching means from the input terminal to any one of said output terminals, said controller means including a magnetic circuit operable between two states as determined by electrical signals, and latching means for retaining the connection from the input terminal to any one of said output terminals notwithstanding interruption of said electrical signals, said latching means including a permanent magnet and a rocker arm, said rocker arm being coupled to said switching means and held in position by the permanent magnet pending the receipt of electrical signals.

2. The invention as claimed in claim 1, in which the switching means is enclosed in a hollow body and wherein the controller means and the latching means are mounted on said hollow body.

3. The invention as claimed in claim 2, in which the hollow body includes a cavity, and the switching means is positioned in the cavity to maintain isolation between signals to the respective output terminals.

4. The invention as claimed in claim 3, in which an opening is provided into the cavity in the hollow body, said opening providing access between the controller means and the switching means.

5. A remotely controlled switch comprising:

an input terminal;

a plurality of output terminals;

switching means for connecting said input terminal separately to each output terminal;

controller means for establishing a connection via said switching means from said input terminal to a selected output terminal;

said controller means including latching means including a permanent magnet providing a magnetic field for retaining the connection from the input terminal to the selected output terminal pending a change by the controller means, and a magnetic circuit operable between two states as determined by electrical signals including a coil and a rocker arm, said coil being responsive to said electrical signals to provide magnetic forces for use in conjunction with said magnetic field to cause deflection of the rocker arm, said magnetic field providing a latching force for the rocker arm between electrical signals, and coupling means located between the rocker arm and the switching means to control the position of the switching means.

6. A remotely controlled switch comprising:

an input terminal and a plurality of output terminals including means for coupling to RF transmission devices, switching means for connecting the input terminal separately to each output terminal and enabling the completion of connections between RF transmission devices, controller means for establishing a connection via said switching means from the input terminal to a selected output terminal;

said controller means including latching means including a permanent magnet providing a magnetic field for retaining the connection from the input terminal to the selected output terminal pending a change by the controller means, and a magnetic circuit operable between two states as determined by electrical signals including a coil and a rocker arm, said coil being responsive to said electrical signals to provide magnetic forces for use in conjunction with said magnetic field to cause deflection of the rocker arm, said magnetic field providing a latching force for the rocker arm between electrical signals, and coupling means located between the rocker arm and the switching means to control the position of the switching means.

7. The invention as claimed in claim 6, in which the switch includes a, hollow body wherein the hollow body is accessible to electrical signals through the input terminal and the output terminals, and wherein the hollow body provides an external support for the controller means and the latching means.

8. The invention as claimed in claim 7, in which the hollow body includes a cavity, and the switching means is positioned in the cavity to maintain isolation between signals to the respective output terminals.

9. The invention as claimed in claim 8, in which an opening is provided into the cavity in the hollow body at the external support, said opening providing access between the controller means and the switching means.

10. A remotely controlled latching switch comprising:

an input terminal, a plurality of output terminals, switching means for connecting the input terminal separately to each output terminal, controller means for establishing a connection via said switching means from the input terminal to any one of said output terminals, said controller means including a magnetic circuit operable between two states as determined by electrical signals, latching means for retaining the connection from the input terminal to the selected output terminal pending a change by the controller means, and a mechanical linkage to the switching means, including a rocker arm, an elongated slot in said rocker arm, a pin, and a slot in said pin, said elongated slot engaging the slot in said pin, whereby the slot in the pin may slide in the elongated slot of the rocker arm to enable desired movement of the switching means.

11. A switching device comprising:

a first terminal, a first and a second additional terminal, connector means for connecting the first terminal alternately to the first and second additional terminals, controller means including a mechanical linkage for controlling said connector means, said contoller means including means for generating a magnetic field, said means for generating a magnetic field enabling changes in the connection of the connector means between the additional terminals, and a permanent magnet, said permanent magnet serving to latch the mechanical linkage of the controller means to maintain the connector means coupled to either the first or the second additional terminal.

12. The invention as claimed in claim 11, in which the terminals are coaxial terminals, and the connector means comprises means for completing connections between coaxial terminals.

13. The invention as claimed in claim 11, in which the mechanical linkage includes a rocker arm of soft iron, and and rocker arm is held in position by action of the permanent magnet in the absence of a magnetic field from the means for generating a magnetic field.

14. The invention as claimed in claim 11, in which the mechanical linkage in the controller means includes a rocker arm, a slot in the rocker arm, a pin, and a slot in the pin, the slot in the rocker arm engaging the slot in the pin, whereby the slot in the pin may slide in the slot in the rocker arm to enable desired movement of the switching means.

15. An electrically controlled switch comprising an input terminal, first and second output terminals, switching means including a first contact end permanently secured to said input terminal and a second contact end switchable between the first and second output terminals, electrically actuated controller means having a mechanical linkage for moving the second contact end of the switching means to complete a connection with the first or second output terminal, and latching means for latching the mechanical linkage and thereby holding said second contact end in contact with either output terminal after the controller means is actuated.

16. The invention as claimed in claim 15, in which the terminals are coaxial terminals, and the switching means comprises means for completing connections between coaxial terminals.

17. The invention as claimed in claim 15, in which the latching means includes a permanent magnet providing a magnetic field, and the mechanical linkage includes an arm formed of soft magnetic material enabling it to be influenced by the magnetic field.

18. The invention as claimed in claim 15, in which the mechanical linkage includes a rocker arm including an elongated slot, and a pin including a slot in engagement with said elongated slot, whereby the pin may slide in the elongated slot of the rocker arm to enable flexible movement of the second contact end.

19. The invention as claimed in claim 15, in which the latching means includes a permanent magnet providing a magnetic field, the mechanical linkage includes an arm formed of soft magnetic material enabling it to be influenced by the magnetic field, said arm being aligned to contact either pole of said permanent magnet, and said arm remaining in position against one pole of the permanent magnet until the electrically activated controller moves said mechanical linkage.

* * * * *